US006935071B2

(12) United States Patent
Yokomori et al.

(10) Patent No.: US 6,935,071 B2
(45) Date of Patent: Aug. 30, 2005

(54) POWERED SLIDING DEVICE FOR VEHICLE SLIDE DOOR

(75) Inventors: Kazuhito Yokomori, Yamanashi-ken (JP); Shoji Wakatsuki, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/464,851

(22) Filed: Jun. 19, 2003

(65) Prior Publication Data

US 2004/0182008 A1 Sep. 23, 2004

(30) Foreign Application Priority Data

Jun. 20, 2002 (JP) ..... 2002-179527

(51) Int. Cl.[7] ..... E05F 11/00

(52) U.S. Cl. ..... 49/360; 49/213; 49/215; 49/358

(58) Field of Search ..... 49/209, 211, 213, 49/214, 215, 216, 325, 358, 360; 296/155

(56) References Cited

U.S. PATENT DOCUMENTS

| | | | | | |
|---|---|---|---|---|---|
| 4,887,390 | A | * | 12/1989 | Boyko et al. | 49/214 |
| 5,806,246 | A | * | 9/1998 | Azuma | 49/360 |
| 6,530,619 | B2 | * | 3/2003 | Fukumoto et al. | 296/155 |
| 2004/0155617 | A1 | * | 8/2004 | Suzuki | 318/434 |

FOREIGN PATENT DOCUMENTS

JP 2001-336352 * 12/2001

* cited by examiner

*Primary Examiner*—Jerry Redman
(74) *Attorney, Agent, or Firm*—Browdy and Neimark, P.L.L.C.

(57) ABSTRACT

In the present powered sliding device for a vehicle slide door, when a center bracket is relatively rotated with respect to a slide door due to an overview shape of a center rail during a sliding movement of the slide door, the center pulley is relatively displaced in a certain amount by the rotation of the center bracket with respect to the slide door, but the center pulley is not displaced any further than the certain amount by the rotation of the center bracket.

2 Claims, 7 Drawing Sheets

CLOSED STATE OPEN STATE

| | WIRING LENGTH BEFORE ADJUSTMENT (A) | | | WIRING LENGTH AFTER ADJUSTMENT (B) | | |
|---|---|---|---|---|---|---|
| DOOR POSITION (mm) | CABLE 21" WIRING LENGTH X (mm) | CABLE 21' WIRING LENGTH X (mm) | TOTAL X + Y (mm) | CABLE 21" WIRING LENGTH X (mm) | CABLE 21' WIRING LENGTH X (mm) | TOTAL X + Y (mm) |
| 0 (全開) FULL OPEN | 851.7 | 114.3 | 966 | 879.2 | 114.3 | 993.5 |
| 200 | 651.7 | 314.3 | 966 | 679.3 | 314.3 | 993.6 |
| 400 | 451.7 | 515.2 | 966.9 | 479.5 | 515.2 | 994.7 |
| 500 | 351.8 | 617.4 | 969.2 | 379.9 | 617.4 | 997.3 |
| 550 | 304.6 | 669.6 | 974.2 | 330.7 | 669.6 | 1000.3 |
| 600 | 269.1 | 722.6 | 991.7 | 278.7 | 722.6 | 1001.3 |
| 625 | 250.9 | 749.1 | 1000 | 250.9 | 749.1 | 1000 |
| 650 | 228.6 | 776.3 | 1004.9 | 228.6 | 776.3 | 1004.9 |
| 675 | 199.5 | 803.3 | 1002.8 | 199.5 | 803.3 | 1002.8 |
| 700 FULL CLOSE | 153.7 | 830.4 | 984.1 | 153.7 | 830.4 | 984.1 |

POWERED SLIDING DEVICE FOR VEHICLE SLIDE DOOR

FIELD OF THE INVENTION

The present invention relates to a powered sliding device of a vehicle slide door.

DESCRIPTION OF THE RELATED ART

A powered sliding device of a vehicle slide door including a slide door slidably mounted on a guide rail provided on a vehicle body, a wire cable coupled to the slide door, and a power unit for pulling the wire cable in a door-opening direction and a door-closing direction with a motor power sp as to slide the slide door in the door-opening direction and the door-closing direction is conventionally known.

FIGS. 1A and 1B show a conventional basic arrangement relationship of a vehicle body A and a slide door B. A lower rail D is fixed in the vicinity of a lower part of an ingress/egress aperture C of the vehicle body A, and a center rail E is fixed on a quarter panel of the vehicle body A. When the ingress/egress aperture C is blocked with the slide door B, the lower rail D is isolated from the outside of the vehicle with the slide door B and protected from rainwater. However, the center rail E is substantially always exposed to the outside and is not protected from rainwater.

The slide door B has a lower roller bracket F and a center roller bracket G which are slidably engaged with the lower rail D and the center rail E, respectively. The roller brackets F and G are pivotally mounted on the slide door B, preferably. The slide door B moves in the door opening direction and the door closing direction through the slidable engagement of the roller brackets and the rails.

The prior art powered sliding device is classified into four types in accordance with the arrangement position. FIGS. 2A and 2B show the first type (refer to U.S. Pat. No. 5,203,112). A power unit H of the first type powered sliding device is provided under the floor panel of the vehicle body in the vicinity of the ingress/egress aperture C. A wire cable J which moves the slide door B with the power of the power unit H is substantively formed into a loop, passing through the lower rail D, and is coupled to the lower roller bracket F. With such configuration, the slide door B is slidable with the movement of the wire cable J by the power of the power unit H.

In the second type device disclosed in U.S. Pat. No. 5,913,563, as shown in FIGS. 3A and 3B, the power unit H is provided in an interior space K of the quarter panel. The loop shaped wire cable J is passed through the center rail E, and is coupled to the center roller bracket G of the slide door B.

In the third type device shown in FIGS. 4A and 4B, the power unit H is provided in the interior space K similar to the second type device (refer to U.S. Pat. No. 4,862,640). The wire cable of the third type device is divided into a door-opening cable J' and a door-closing cable J", and the opening cable J' is guided by the lower rail D to be coupled to the lower bracket F of the slide door B, and the closing cable J" is guided by the center rail E to be coupled to the center bracket G of the slide door B.

In the fourth type device, as shown in FIGS. 5A and 5B, the power unit H Is provided inside the slide door B (Japanese Patent Laid-Open No. 2001-336352). The wire cable of the fourth type device is also divided into the opening cable J' and the closing cable J". The opening cable J' is fixed to a rear end portion of the center rail E by way of the center bracket G, and the closing cable J" is fixed to a front end portion of the center rail E by way of the center bracket G.

In the first type device, an installation space for the power unit H must be defined under the floor panel of the vehicle body, and thus the first type device has a disadvantage that the vehicle interior space becomes narrow. Further, a path for the wire cable J which has to be provided under the floor panel narrows the vehicle interior space. On the other hand, in the first type device, the wire cable J is substantively formed into a single endless form, and thus has an advantage that a substantive loosening of the wire cable J does not arise during the sliding movement of the slide door B.

In the second type device, the power unit H is provided in the interior space K of the quarter panel and thus the second type device has a disadvantage, similar to the first type device, that the vehicle interior space becomes narrow. Further, a pulley for guiding the wire cable J which has to be provided on each of the front and back ends of the center rail E further narrows the vehicle interior space. Additionally, in the second type device, even if the slide door B is in the closed state, the wire cable J is permanently positioned in the center rail E over the entire length. The center rail E is, in effect, always exposed to the outside and thus is not protected from rainwater. Therefore, the second type device has a disadvantage that due to the rainwater falling on the center rail E, the grease and the like applied to the wire cable J may come off, causing the quarter panel to be dirty. There is also a problem that dust may adhere on the wire cable J permanently positioned in the center rail E. On the other hand, the second type device has an advantage that a substantive loosening of the wire cable J does not arise during the sliding movement of the slide door B since the wire cable J is substantively formed in single endless form.

In the third type device, if the slide door B is In the closed state, the closing cable J" is not, in effect, present in the center rail E, and thus problems of quarter panel becoming dirty, and dust adhering on the closing cable J" are alleviated. However, the power unit H is provided in the interior space K of the quarter panel and a pulley must be provided at the front end of the center rail E to guide the closing cable J". Thus, there is a disadvantage that the vehicle interior space becomes narrow, as in the first and the second type. Further, in the third type device the wire cable is divided into the opening cable J' and the closing cable J", and each cable is separately guided by the lower rail D and the center rail E, respectively. Thus there is a problem that the wire cable J is substantively loosened during the sliding movement of the slide door B. That is, since the wounded amount (or pulled-out amount) of the opening cable J' and the pulled-out amount (or wounded amount) of the closing cable J" is equal, the total amount of the cable length (actual length from the power unit H to the distal end of the cable) of both cables J' and J" do not change even if the slide door B slides, but the wiring length of the cable (shortest distance of the wiring from the power unit H to the distal end of the cable) changes, affecting the tension of the cable. The change in the wiring length occurs due to the difference of the overview shapes of the lower rail D and the center rail E. Therefore, in U.S. Pat. No. 4,862,640, a large sized tension mechanism for preventing the loosening is provided in the interior space K of the quarter panel.

In the fourth type device, the power unit H is provided inside the slide door B, and there is no need to attach a pulley to the center rail E and thus there is an advantage of effectively utilizing the vehicle interior space. However, even if the slide door B is in the closed state, one part of the opening cable J' is permanently located in the center rail E, and thus the fourth type device has a disadvantage that the grease and the like applied to the opening cable J' may come off, causing the quarter panel to become dirty. There is also a problem of dust adhering on the door opening cable J' that is permanently positioned in the center rail E. In the fourth type, there is also a problem that the wire cable J is substantively loosened during the sliding movement of the slide door B. The loosening problem of the cable in the fourth type device is different from that of the third type. In the fourth type, the wire cable is divided into the opening cable J' and the closing cable J", but since such cables are guided by the common center rail E, the overview shape of the lower rail D is not related to the loosening of the cable. In the fourth type, the loosening of the cable is caused by the swinging motion of the center bracket G. That is, the cables J' and J" are both connected to the vehicle body by way of the center bracket G, and the wiring length of the cable changes when the center bracket G swings with the movement of the slide door B. In order to avoid such problem, Japanese Patent Laid-Open No. 2001-336352 discloses a configuration in which the center bracket G is configured in a special way to solve the above problem.

SUMMARY OF THE INVENTION

Therefore, it is an object of the present invention to provide a powered sliding device in which the power unit is provided inside the slide door to effectively utilize the vehicle interior space, in which the opening cable is passed through the lower rail and the closing cable is passed through the center rail to greatly alleviate the problems of the quarter panel becoming dirty and dust adhering on the cable and in which the change of wiring length of the opening cable and the closing cable that occurs during the movement of the slide door is rationally prevented with a simple configuration.

DESCRIPTION OF THE PREFERRED EMBODIMENTS

Figure 1A:
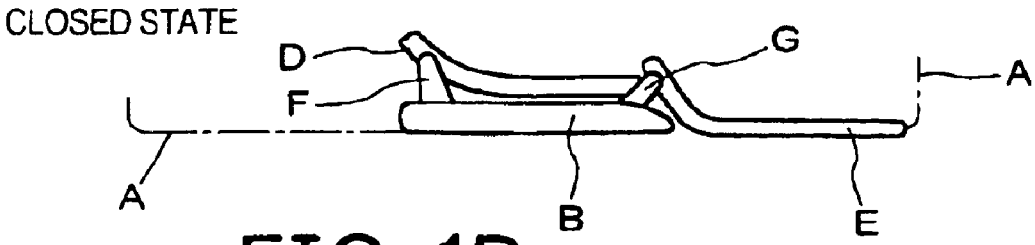
FIG. 1A (PRIOR ART)
FIG. 1A is a view showing a conventional basic relationship between a vehicle body and a slide door, in which the slide door is in a closed state.
Figure 1B:
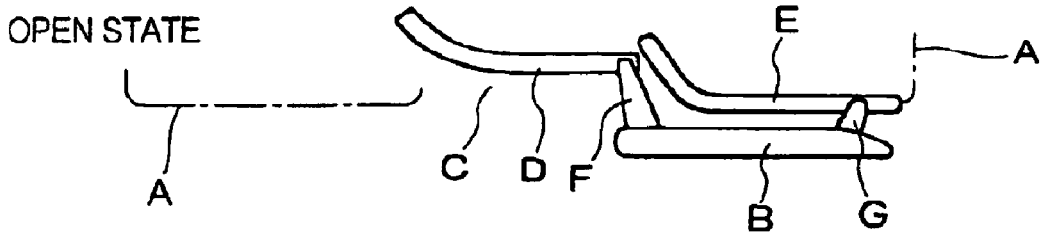
FIG. 1B (PRIOR ART)
FIG. 1B is a view showing the conventional basic relationship between the vehicle body and the slide door, in which the slide door is in an open state.
Figure 2A:
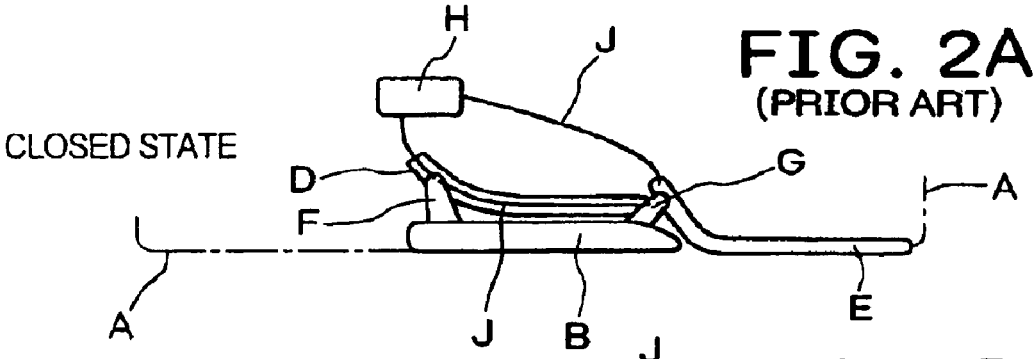
FIG. 2A (PRIOR ART)
FIG. 2A is a view showing a first type of a conventional power unit and a wire cable, in which the slide door in the closed state.
Figure 2B:
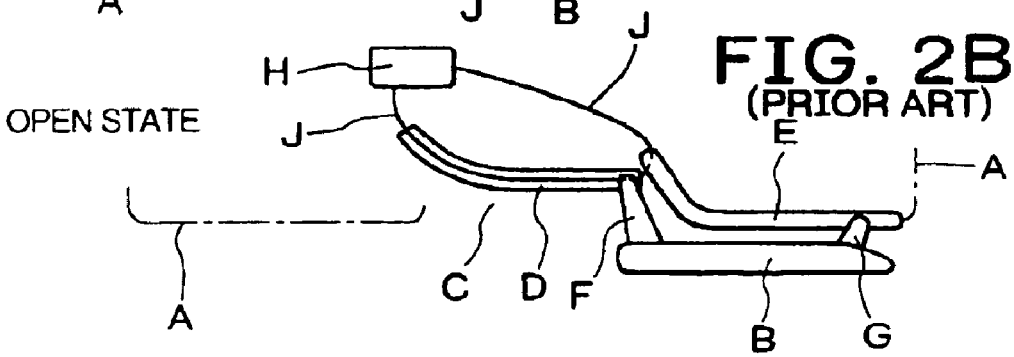
FIG. 2B (PRIOR ART)
FIG. 2B is a view showing the first type of the conventional power unit and the wire cable, in which the slide door in the open state.
Figure 3A:
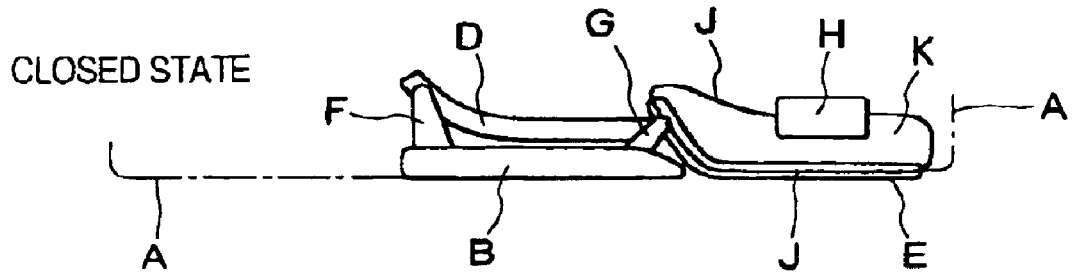
FIG. 3A (PRIOR ART)
FIG. 3A is a view showing a second type of a conventional power unit and a wire cable in which the slide door in the closed state.
Figure 3B:
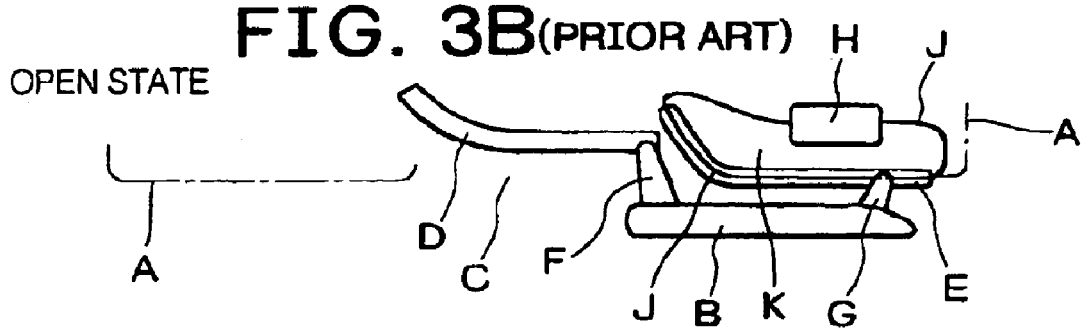
FIG. 3B (PRIOR ART)
FIG. 3B is a view showing the second type of the conventional power unit and the wire cable, in which the slide door in the open state.
Figure 4A:
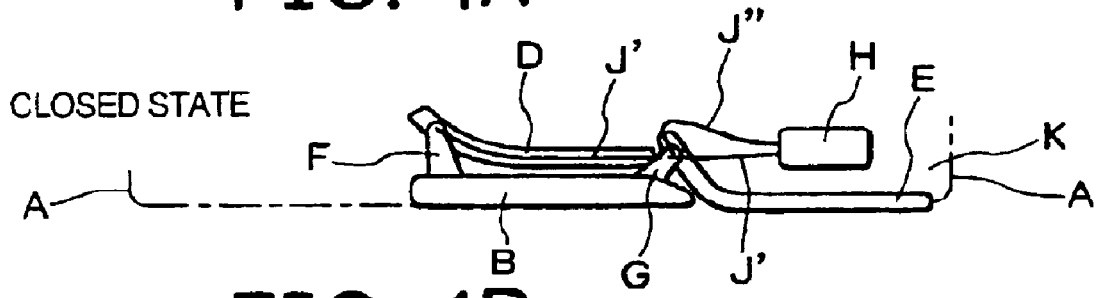
FIG. 4A (PRIOR ART)
FIG. 4A is a view showing a third type of a conventional power unit and a wire cable, in which the slide door In the closed state.
Figure 4B:
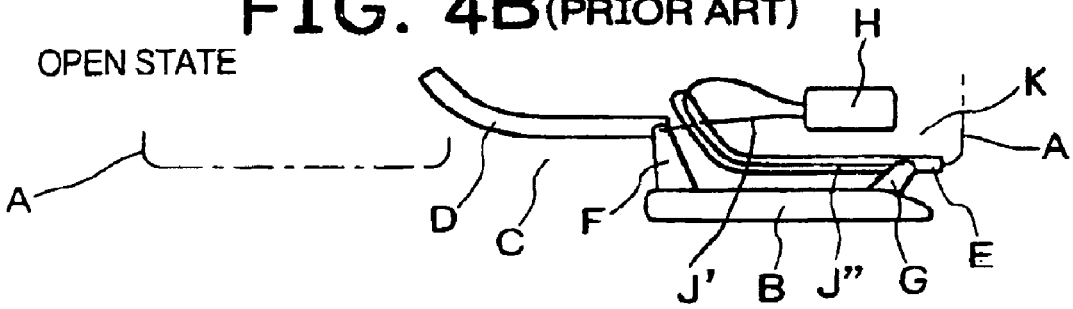
FIG. 4B (PRIOR ART)
FIG. 4B is a view showing the third type of the conventional power unit and the wire cable, in which the slide door in the open state.
Figure 5A:
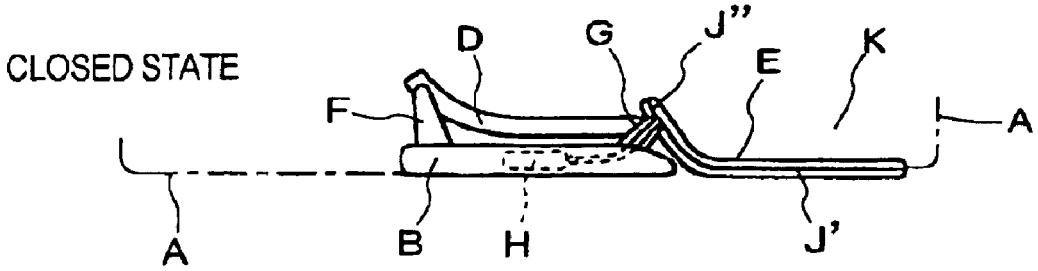
FIG. 5A (PRIOR ART)
FIG. 5A is a view showing a fourth type of a conventional power unit and a wire cable, in which the slide door in the closed state.
Figure 5B:
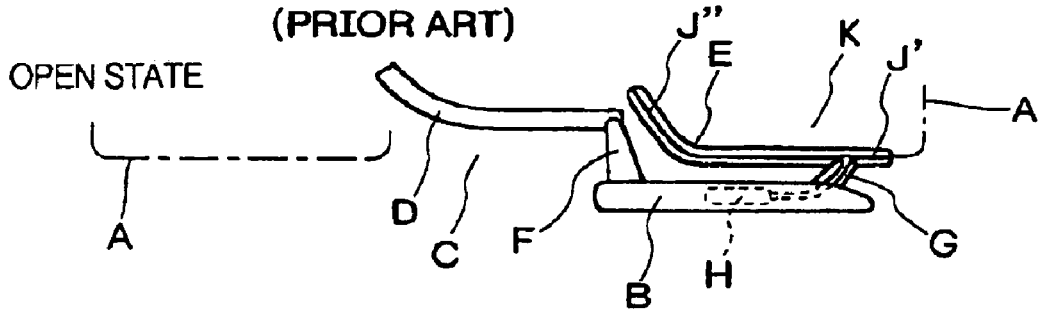
FIG. 5B (PRIOR ART)
FIG. 5B is a view showing the fourth type of the conventional power unit and the wire cable, in which the slide door in the open state.
Figure 6:
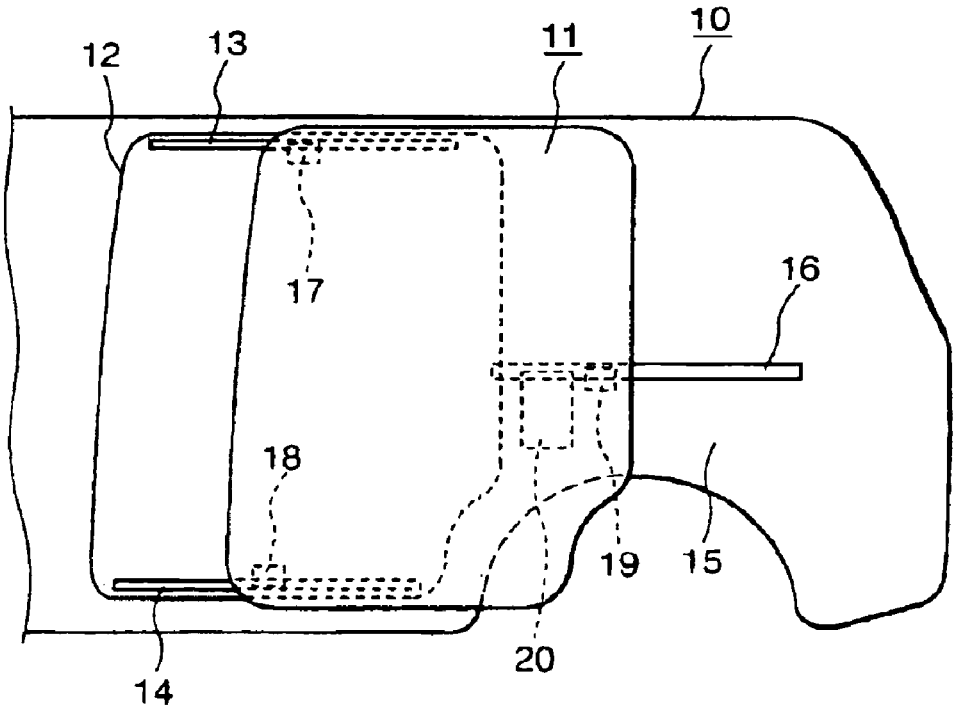
FIG. 6 is a side view of a vehicle provided with a powered sliding device according to the present invention.
Figure 7:
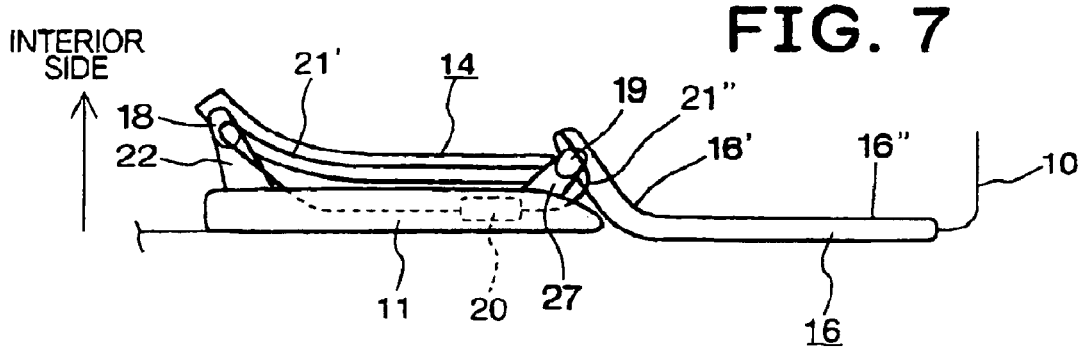
FIG. 7 is a view showing a relationship between a power unit and a wire cable of the powered sliding device, in which the slide door in the closed state.
Figure 8:
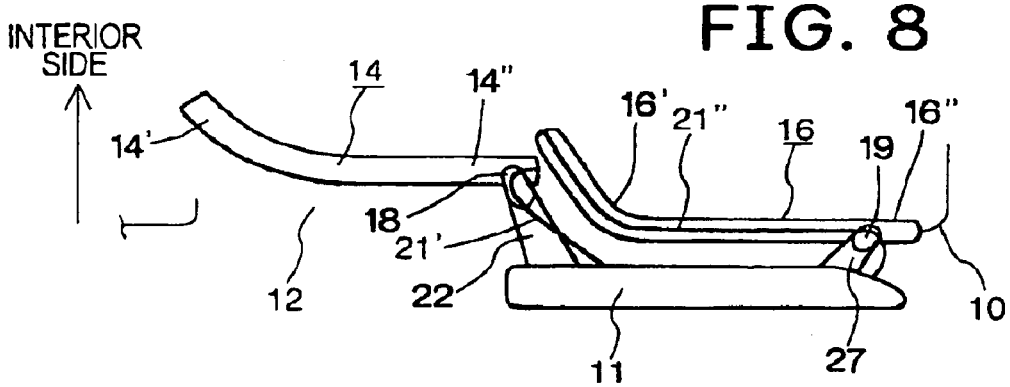
FIG. 8 is view showing the relationship between the power unit and the wire cable of the powered sliding device, in which the slide door in the open state.

The preferred embodiment' of the present invention will now be explained with reference to the drawings. FIG. 6 shows a vehicle body 10, a slide door 11 slidably attached to the vehicle body 10, and an ingress/egress aperture 12 which can be blocked by the slide door 11. An upper rail 13 is fixed to the vehicle body 10 in the vicinity of an upper part of the ingress/egress aperture 12, a lower rail 14 is fixed to the vehicle body 10 in the vicinity of a lower part of the ingress/egress aperture 12, and a center rail 16 is fixed to a quarter panel 15 as a rear side panel of the vehicle body 10. When the ingress/egress aperture 12 is blocked by the slide door 11, the upper rail 13 and the lower rail 14 are isolated from the outside of the vehicle by the slide door 11 and protected from rainwater. However, the center rail 16 is substantively always exposed to the outside and thus is not protected from rainwater.

The slide door 11 has an upper roller bracket 17, a lower roller bracket 18 and a center roller bracket 19 which are slidably engaged with the upper rail 13, the lower rail 14 and the center rail 16 respectively. The roller brackets 17, 18 and 19 are pivotally mounted on the slide door 11, preferably. The slide door 11 is movable in the door opening direction and the door closing direction through the slidable engagement of the roller brackets and the rails.

A power unit 20 having a motor power is provided in the inside space of the slide door 11. The power unit 20 preferably includes a wire drum for winding and pulling out the wire cable. One end of each of the two wire cables, i.e., the door opening cable 21' and the door closing cable 21" is coupled to the wire drum. When the wire drum Is rotated in the opening direction, the opening cable 21' is wounded, and the closing cable 21" is pulled out. When the wire drum is rotated in the closing direction, the opening cable 21' is pulled out and the closing cable 21" is wounded.

Figure 9:
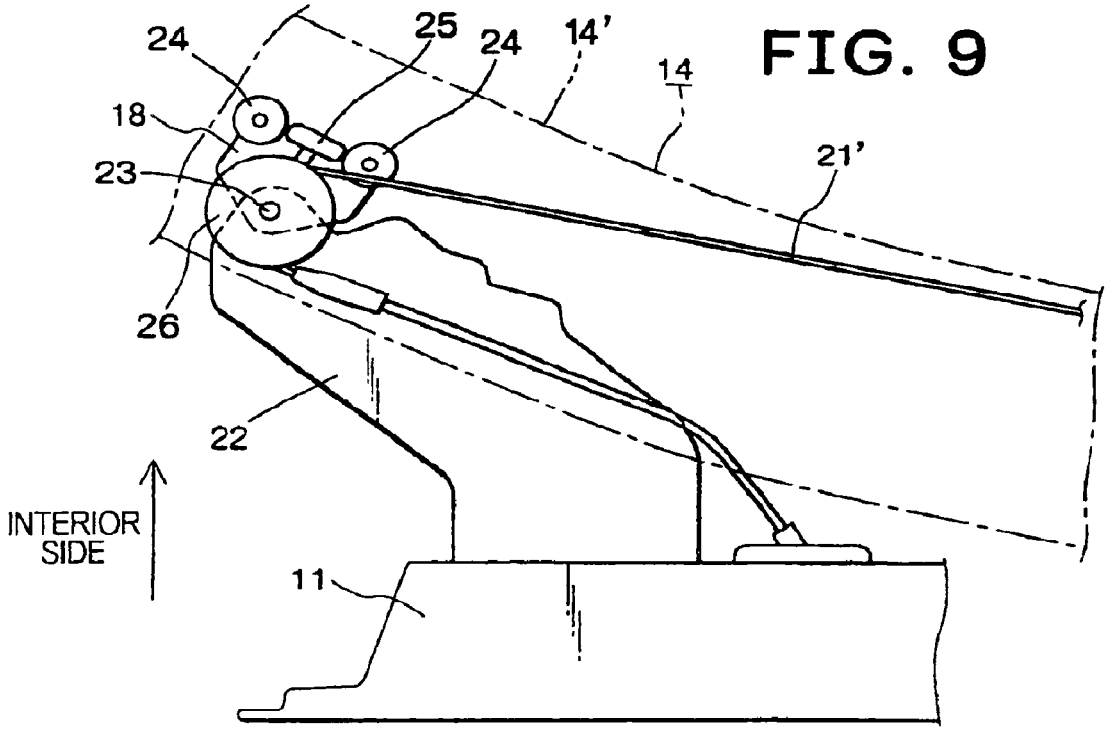
FIG. 9 is an enlarged plan view of a lower rail and a lower roller bracket of the slide door.

As shown in FIG. 9, a lower stay 22 extending toward the interior side of the vehicle is fixed at the lower position on the front side of the slide door 11, and the lower bracket 18 is pivotally mounted on the interior side end of the lower stay 22 by means of a vertical supporting shaft 23. It is known that the lower bracket 18 is pivotally provided with vertical axial rollers 24, 24 and a horizontal axial roller 25 which are slidably engaged with the lower rail 14. A lower pulley 26 is rotatably mounted on the lower end of the vertical supporting shaft 23.

The distal end of the opening cable 21' is pulled out toward the outside of the slide door 11 from the lower position on the front side of the slide door 11, namely, the position in the vicinity of the lower stay 22. The distal end of the opening cable 21' is extended in the backward direction within the lower rail 14 by way of the front side of the lower pulley 26, and fixed to the rear end portion of the lower rail 14 or to the vehicle body 10 in the vicinity of thereof. Thus, when the opening cable 21' is wounded in the door-closed state, the opening cable 21' moves the slide door 11 in the backward direction (opening direction) by way of the lower pulley 26.

Figure 10:
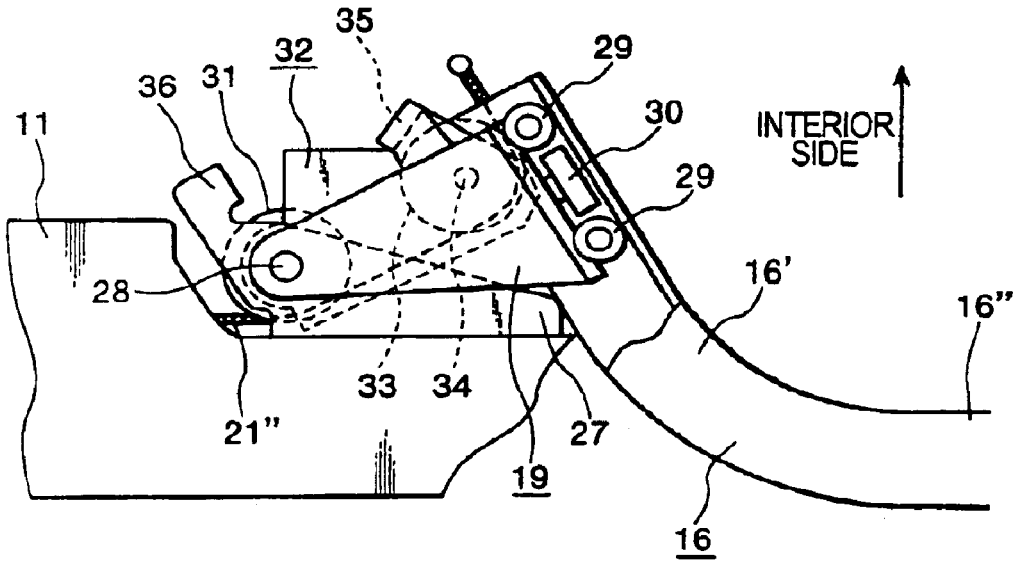
FIG. 10 is an enlarged plan view of a center rail and a center roller bracket of the slide door when the slide door is in the closed state.
Figure 11:
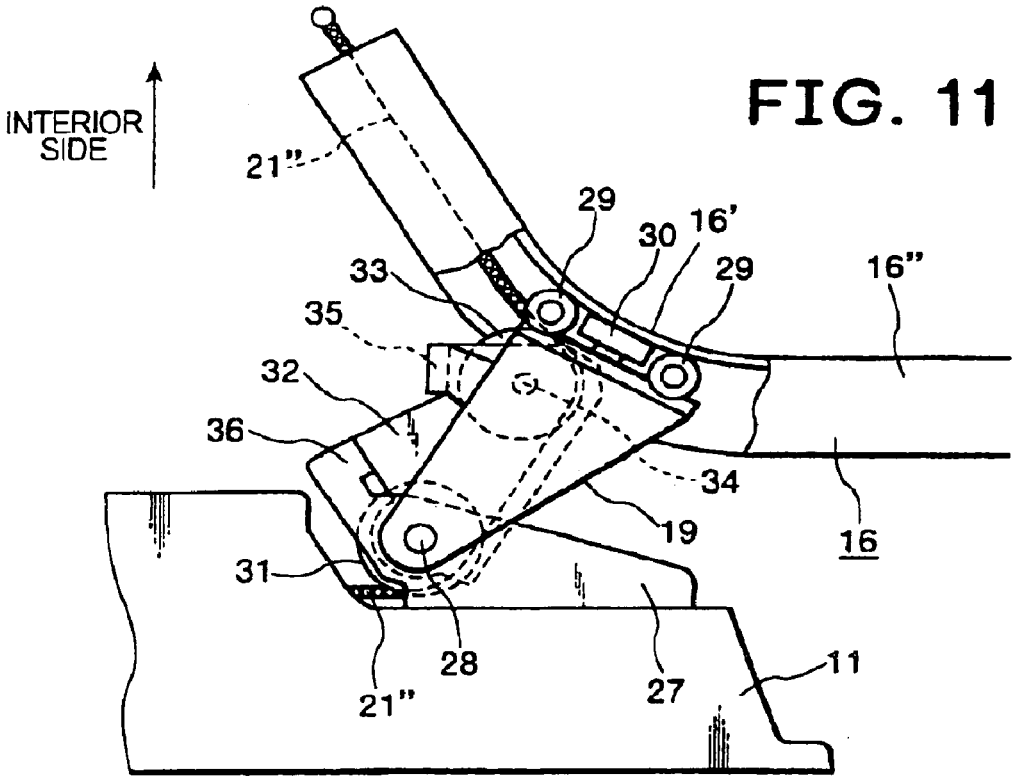
FIG. 11 is an enlarged plan view of the center rail and the center roller bracket of the slide door when the slide door is in an initial open state.
Figure 12:
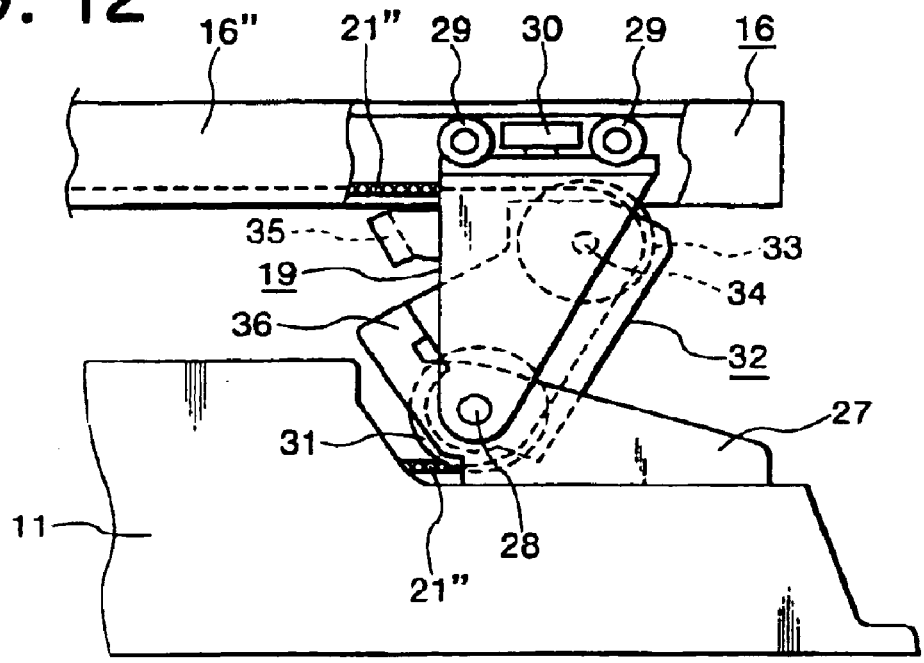
FIG. 12 is an enlarged plan view of the center rail and the center roller bracket of the slide door when the slide door is in a full-open state.

As shown in FIGS. 10 to 12, a center stay 27 extending toward the interior side is fixed to the central portion in the upper and lower direction of the rear side of the slide door 11, and the center bracket 19 is pivotally mounted on the interior side end of the center stay 27 by means of a vertical supporting shaft 28. It is known that the center bracket 19 is pivotally provided with vertical axial rollers 29, 29 and a horizontal axial roller 30 which are slidably engaged with the center rail 16. A first center pulley 31 is rotatably mounted on the lower end of the vertical supporting shaft 28.

Figures 14, 15:
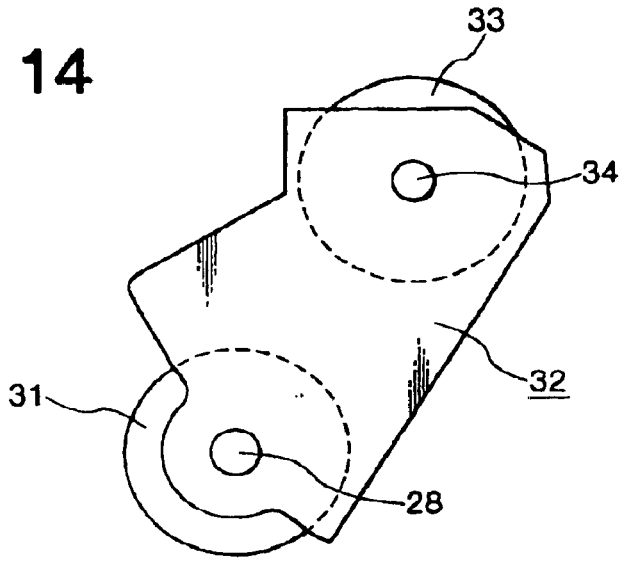
FIG. 14 is a plan view of a swinging arm.
FIG. 15 is a comparison view showing the cable wiring length before adjustment and after adjustment.

Reference numeral 32 denotes a swinging arm (refer to FIG. 14) pivotally mounted on the vertical supporting shaft 28, and a second center pulley 33 positioned near to the center rail 16 with respect to the first pulley 31 is rotatably attached to a rotating side portion of the swinging arm 32 with a pin 34. In the present embodiment, two center pulleys 31 and 33 are configured so as to be attached to the swinging arm 32 in advance, and the assembling of the pulleys 31 and 33 are facilitated.

Figure 13:
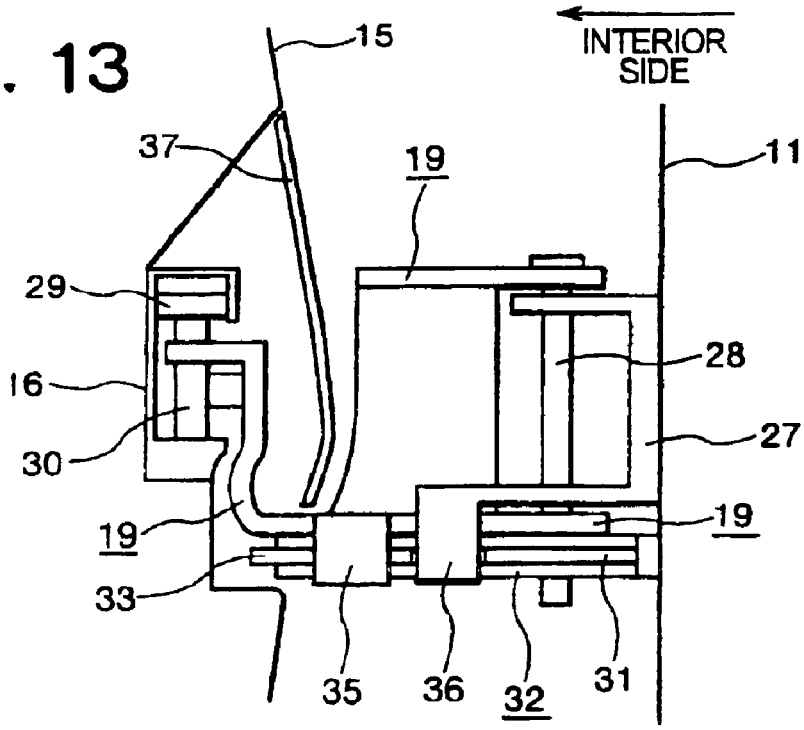
FIG. 13 is a side view of the center bracket and the periphery thereof.

The distal end side of the closing cable 21" is pulled out to the outside of the slide door 11 from the central portion in the upper and lower direction of the rear side of the slide door 11, i.e., the position in the vicinity of the center stay 27. The distal end of the closing cable 21" is extended in the forward direction within the center rail 16 by way of the rear side of the first center pulley 31 and the second center pulley 33, and fixed to the front end portion of the center rail 16 or to the vehicle body 10 in the vicinity of thereof. Thus, when the closing cable 21" is wounded in the door-open state, the closing cable 21" moves the slide door 11 in the forward direction (closing direction) by way of the center bracket 19. In FIG. 13, reference numeral 37 denotes a dust/water protective cover for the center rail 16.

The overview shape of each of the lower rail 14 and the center rail 16 is well known. The front side portion of the lower rail 14 is formed into a gently curved portion 14' which gently curves toward the interior side, and the rear portion of the gently curved portion 14' is formed in a straight portion 14" with a substantively linear shape. In the center rail 16, the front side portion thereof is formed into a sharply curved portion 16' which relatively strongly curves toward the interior side, and the rear portion of the sharply curved portion 16' is formed in a straight portion 16" having a substantively linear shape.

The center bracket 19 is constantly maintained at a same angle with respect to the center rail 16 with the function of the vertical axial rollers 29, and thus in the door-closed state in which the center bracket 19 is engaged with the sharply curved portion 16', the center bracket 19 is held at a substantively parallel state with respect to the slide door 11. As the center bracket 19 approaches the straight portion 16" with the sliding movement of the slide door 11 in the open direction, the center bracket 19 is rotated so as to gradually stand with respect to the slide door 11.

Since the second center pulley 33 is subjected to pressure from the closing cable 21", the swinging arm 32 pivotally mounted on the vertical supporting shaft 28 is constantly biased in the counterclockwise direction. And, when the swinging arm 32 is rotated counterclockwise, the wiring length of the closing cable 21" (shortest length of the wiring from the wire drum to the distal end of the cable) becomes shorter, and when the swinging arm 32 is rotated clockwise, the wiring length becomes longer. A bent part 35 for restricting the rotational range of the swinging arm 32 in the counterclockwise direction is provided on the center bracket 19, and a pressing part 36 is provided on the center stay 27 to abut against the swinging arm 32 and push the swinging arm 32 in the clockwise direction when the center bracket 19 approaches the standing state with respect to the slide door 11.

The relationship among the swinging arm 32, the bent part 25 of the center bracket 19, and the pressing part 36 of the center stay 27 is mentioned below. In the door-closed state shown in FIG. 10, the center bracket 19 is positioned at the distal end of the sharply curved portion 16' and is substantively parallel to the slide door 11, and the swinging arm 32 is brought into contact with the bent part 35 of the center bracket 19. In this state, when the power unit 20 is operated to open the door, the opening cable 21' is wounded by the wire drum, and the closing cable 21" is pulled out. Here, the wounded amount of the opening cable 21' by the wire drum and the pulled-out amount of the closing cable 21" is equal. When the slide door 11 is slidably moved in the opening direction by the opening actuation of the power unit 20, the center bracket 19 is moved in the rearward direction within the sharply curved portion 16' and is gradually rotated in the counterclockwise direction so as to be in the standing position with respect to the slide door 11. During this moment, the swinging arm 32 which comes into contact with the bent part 35 of the center bracket 19 is also rotated in the counterclockwise direction with respect to the slide door 11, and as shown in FIG. 11, the swinging arm 32 is brought into contact with the pressing part 36 of the center stay 27. When the center bracket 19 is further moved in the rearward direction, since the swinging arm 32 cannot be rotated further with respect to the slide door 11 due to the contact with the pressing part 36 of the center stay 27, the center bracket 19 is independently rotated with respect to the slide door 11, remaining the swinging arm 32. After that, as show in FIG. 12, the center bracket 19 is moved in the rearward direction in the straight portion 16".

In this series of operation, the total amount of the cable length (actual length from the wire drum to the distal end of the cable) does not change since the wounded amount of the opening cable 21' and the pulled out amount of the closing cable 21" are equal. However, the total amount of the wiring length (shortest length of wiring from the wire drum to the distal end of the cable) of both cables 21' and 21" changes with the movement of the slide door 11. This results because the sharply curved portion 16' of the center rail 16 and the gently curved portion 14' of the lower rail 14 each have different curvature and because the lengths thereof are different from each other. The wiring length changes greatly in a configuration in which the swinging arm 32 constantly moves integrally with the center bracket 19, or in a configuration in which the second center pulley 33 is omitted. More simply, the wiring length in the door-open state is shorter than the wiring length in the door-closed state. This is shown in the column (A) in FIG. 15, where the change in the total amount of wiring length is great. The change in the total amount of wiring length greatly affects the setting of the cable tension.

In the present embodiment, the change in the wiring length as a result of the movement of the slide door 11 is made small as possible with a simple configuration. With the sliding movement in the opening direction of the slide door 11, after the swinging arm 32 is brought into contact with the pressing part 36 of the center stay 27 as shown in FIG. 11, the center bracket 19 is independently rotated with respect to the slide door 11, remaining the swinging arm 32. When the center bracket 19 is rotated independently, the distance between the center bracket 19 and the swinging arm 32 gradually increases, thus an effect of gradually extending the cable wiring length can be expected. That is, with the sliding movement in the opening direction of the slide door 11, the wiring length is prevented from becoming short.

The adjustable wiring length of the cable by the contact between the swinging arm 32 and the pressing part 36 is subject to a timing of when the swinging arm 32 is brought into contact with the pressing part 36 of the center stay 27, and the length of the swinging arm 32 (length between the first center pulley 31 and the second center pulley 33) and the like. These factors are derived through calculation (measuring experiment) based on the overview shapes of the lower rail 14 and the center rail 16. That is, firstly, the changing value of the wiring length in case of where the arm 32 is non-rotatably fixed to the center bracket 19 is measured as shown in the column (A) of FIG. 15, and design them so as to absorb these change. In the column (B) of FIG. 15, the wiring length of the cable adjusted by the configuration of the present invention is shown. It is apparent that a significant adjustment result is obtained with a simple configuration.

The above description is based on the sliding movement in the opening direction of the slide door 11, but it can be clearly recognized that in the opposing principle, in which the slide door slides In the closing direction, the wiring length of the cable is prevented from gradually becoming longer with the configuration of the present invention.

In the above mentioned configuration, since the center bracket 19 is position in the vicinity of the front end portion of the center rail 16 when the slide door 11 is in the closed state, only a few part of the closing cable 21" is positioned in the center rail 16 in the door-closed state. Thus, the closing cable 21" is prevented from being directly exposed to rainwater and the grease and the like on the door closing cable 21' is substantively prevented from coming off, thus the quarter panel 15 is prevented from becoming dirty.

The power unit 20 is provided in the inside space of the slide door 11, and a pulley for guiding the wire cable of the power unit 20 is not provided in the center rail 16 and the lower rail 14. Therefore, a problem of the vehicle interior space of the vehicle 10 narrowing does not arise.

Advantages of the Invention

According to the present invention, the vehicle interior space is effectively used by arranging the power unit 20 inside the slide door 11, the problems of quarter panel 15 becoming dirty and dust adhering to the cable 21" are greatly alleviated by passing the door opening cable 21' through the lower rail 14 and the door closing cable 21" through the center rail 16, and furthermore, the change in the wiring length of the door opening cable 21' and the door closing cable 21" that occurs during the movement of the slide door Is rationally prevented with a simple configuration.

What is claimed is:

1. A powered sliding device engaged to a vehicle slide door including a wire cable coupled to the slide door which is slidably mounted on a vehicle body in a forward door opening direction and a rearward door closing direction, the powered sliding device sliding the slide door in the door opening direction and the door closing direction by moving the wire cable with a motor power of a power unit, comprising:

a lower rail provided in the vicinity of a lower part of an ingress/egress aperture of the vehicle body, said lower rail being protected from rainwater from an outside of the vehicle body when the slide door is closed;

a lower bracket provided to the slide door and slidably engaged with the lower rail;

a center rail provided at a quarter panel of the vehicle body, said center rail being exposed to rainwater when the slide door is closed;

a center bracket provided to the slide door and slidably engaged with the center rail;

said power unit being provided in an inside space of the slide door;

said wire cable including a door opening cable and a door closing cable, each of base side ends of the door opening cable and the door closing cable being coupled to the power unit;

a distal end of the door opening cable being protruded outside the slide door from a position in the vicinity of the lower bracket of the slide door, extended in a rearward direction within the lower rail by way of a front side of a lower pulley of the lower bracket, and fixed to the vehicle body in the vicinity of a rear end of the lower rail;

a distal end of the door closing cable being protruded outside the slide door from a position in the vicinity of the center bracket of the slide door, extended in a forward direction within the center rail by way of a rear side of a center pulley of the center bracket, and fixed to the vehicle body in the vicinity of a front end of the center rail;

wherein when said center bracket is relatively rotated with respect to the slide door due to a shape of the center rail during the sliding movement of the slide door, said center pulley is relatively displaced in a certain amount by the rotation of the center bracket with respect to the slide door, but said center pulley is not displaced any further than the certain amount by the rotation of the center bracket.

2. The powered sliding device for the vehicle slide door according to claim 1, further comprising a swinging arm pivotally mounted on the slide door with a vertical supporting shaft, said center pulley being pivotally mounted on a rotating side end of the swinging arm with a pin to bias the swinging arm in a predetermined direction by a pressure from the door closing cable, a bent part provided on the center bracket, said swinging arm being brought into contact with the bent part by being biased in the predetermined direction, a pressing part provided on the slide door for abutting against the swinging arm to restrict the rotation of the swinging arm when the center bracket is rotated over the certain amount with respect to the slide door.

* * * * *